United States Patent [19]

Boranian et al.

[11] 4,041,200

[45] Aug. 9, 1977

[54] STACK OF TILES WHICH HAVE A RELEASE LAYER ON ONE MAJOR FACE AND AN ADHESIVE LAYER ON THE OPPOSED MAJOR FACE DOES NOT REQUIRE DISPOSABLE RELEASE INTERLAYERS

[75] Inventors: Armen G. Boranian, New Windsor; Walter C. Timm, Newburgh, both of N.Y.

[73] Assignee: GAF Corporation, New York, N.Y.

[21] Appl. No.: 639,839

[22] Filed: Dec. 11, 1975

[51] Int. Cl.[2] ..... B05D 5/10; B32B 7/14; B32B 31/12; E04F 13/20; E04F 15/10

[52] U.S. Cl. ..... 428/40; 156/247; 156/249; 156/289; 156/291; 427/208; 428/202; 428/352; 428/354; 428/913

[58] Field of Search ..... 427/208, 207; 428/40, 428/346, 352, 354, 202; 156/247, 249, 289, 291

[56] References Cited

U.S. PATENT DOCUMENTS

| | | | |
|---|---|---|---|
| 2,647,849 | 8/1953 | Douglas et al. | 427/208 |
| 3,050,411 | 8/1962 | Keil | 428/352 |
| 3,075,853 | 1/1963 | Striker et al. | 428/352 |
| 3,394,799 | 7/1968 | Ritson et al. | 428/352 |
| 3,620,366 | 11/1971 | Parkinson et al. | 428/352 |
| 3,630,980 | 12/1971 | Russell | 260/829 |
| 3,690,924 | 9/1972 | Estes | 428/352 |
| 3,736,281 | 5/1973 | Russell | 526/281 |
| 3,903,340 | 9/1975 | Shepherd | 427/208 |

*Primary Examiner*—J.C. Cannon

*Attorney, Agent, or Firm*—Walters C. Kehm; Joshua J. Ward

[57] ABSTRACT

Rigid surface covering materials such as vinyl or vinyl asbestos floor or wall tiles having pressure sensitive adhesive adhered to one surface thereof and a release agent for the adhesive adhered to the opposite surface. This enables vinyl tile, etc. coated with pressure sensitive adhesive to be stored without the use of release paper.

13 Claims, No Drawings

STACK OF TILES WHICH HAVE A RELEASE LAYER ON ONE MAJOR FACE AND AN ADHESIVE LAYER ON THE OPPOSED MAJOR FACE DOES NOT REQUIRE DISPOSABLE RELEASE INTERLAYERS

BACKGROUND OF THE INVENTION

Rigid surface covering material such as floor or wall tile, wood or simulated wood paneling, etc. has in the past generally been adhered to the wall, floor or other surface being covered by spreading adhesive on the covering material or the surface to be covered during the installation process. More recently it has been suggested that a suitable adhesive could be precoated on the tile or other covering material during manufacture thereof. Such a tile product and method for making same is, for instance, disclosed in U.S. Pat. No. 3,607,590. Use of such precoated materials has many obvious advantages over application of the adhesive during installation. Unfortunately, while rolls of tape and other light weight, flexible materials have been successfully made with precoated adhesive and stored and used without the necessity for separate layers of release material, the rigidity and weight of surface covering materials such as floor or wall tiles, paneling etc. has necessitated the use of controlled release backing layers such as silicone release paper to prevent pieces of such material from sticking to each other when such materials are stored with precoated adhesive. This is understandable when it is considered that under normal conditions of storage such rigid materials are stacked in such a manner that pressures between about 30 and about 500 lbs. per square foot are exerted on the bottom layers of material for long periods of time. The use of controlled release backing layers requires additional effort and expense, both in applying the additional release layers to the covering material and in removing it during the installation process.

SUMMARY OF THE INVENTION

It is, therefore, an object of the present invention to provide an improved rigid surface covering material such as vinyl, vinyl asbestos, asphalt or rubber floor or wall tile, etc. which has pressure sensitive adhesive adhered thereto and which does not require the use of release paper to keep the tiles or other pieces of covering material separated prior to installation on surfaces to be covered.

In accordance with the invention, rigid surface covering material such as pieces of floor or wall tiles, etc. are provided which have pressure sensitive adhesive adhered to one surface thereof and release agent for such adhesive adhered to the opposite surface thereof. Preferred embodiments of the invention include the use of conventional vinyl chloride based tiles with hot melt type pressure sensitive adhesive and silicone based release agents.

The invention also provides a process for making and packaging rigid surface covering material by which pieces of such material as described above are produced and then stacked for storage in such a manner that at least a majority of the surfaces of such pieces having adhesive adhered thereto are in direct contact with surfaces of such pieces having release agents adhered thereto.

DETAILED DESCRIPTION OF THE INVENTION

As mentioned above the invention provides rigid surface covering material having pressure sensitive adhesive adhered to one surface thereof and release agent for said adhesive adhered to the opposite surface thereof. The term "rigid surface covering material" as used herein is intended to mean materials such as floor or wall tiles, decorative panels, etc. which are not sufficiently flexible to be easily rolled for storage or transportation. Because they cannot be easily rolled, pieces of such materials must usually be stacked for storage and transportation in such a manner that considerable pressure, eg. between about 30 and about 500 pounds per square foot (lbs/ft.$^2$), is exerted on the bottom most layers of material for an extended period of time. As mentioned above, such materials have in the past been precoated with adhesive only in conjunction with the use of controlled release layers between layers of adhesive coated rigid covering material.

Vinyl tiles such as conventional vinyl or vinyl asbestos floor or wall tiles are especially preferred in practicing the invention. Such vinyl tiles normally comprise vinyl resin, filler, plasticizer and stabilizer for the resin and may frequently also be provided with additional topcoatings of ink, wax, wear layers, etc. Preferred vinyl resins for use in forming such conventional tiles include vinyl chloride homopolymers, vinyl chloride/vinyl acetate copolymers and mixtures thereof. Vinyl chloride/vinyl acetate copolymers used normally have a ratio of vinyl chloride to vinyl acetate units between about 4 to 1 and about 10 to 1. Other suitable vinyl resins include, for instance, vinyl chloride copolymerized with such comonomers as vinylidene chloride, vinyl propionate, vinyl butyrate or the acrylates or methacrylates. Hydrocarbon resins based on petroleum, low molecular weight $\alpha$-methylstyrenes, plasticized polystyrenes and like materials may be used as extender resins in the manner known in the art.

Suitable fillers for use in conventional tiles used in practicing the invention include materials such as asbestos, limestone, talc, organic fibers, etc. and are frequently used in amounts ranging from about 50 to about 80 wt. % of the tile base material, i.e. total weight of tile excluding surface coverings. Likewise, conventional plasticizers such as butylbenzyl phthalate, diisodecyl phthalate, di(2-ethylhexyl) phthalate, diisononyl phthalate, 2,2,4-trimethyl-1,3-pentanediol isobutyrate benzoate, epoxidized soy bean oil, etc. may be used. Such plasticizers are commonly used in amounts between about 25 and about 50 wt. % of the resin present in the tile base. Suitable conventional stabilizers may also be used in the tile base in amounts between such ½ and about 8 wt. % based on resin and may include such materials as mixtures of barium and cadmium salts of organic acids, mixtures of barium and zinc salts of organic acids, phosphites, or preferably dicyandiamide if asbestos is present.

In addition to the ingredients mentioned above, the tile base used in producing floor tiles suitable for use in the present invention may also include other conventional ingredients such as pigments, inks, chips to produce a mottled surface appearance, etc. Where other surface coatings of chips, ink, etc. are not used, the use of a conventional emulsion prime or seal coat of clear latex is preferred on the surface of the tile base to which the release agent is adhered. This will normally serve to reduce the total amount of release agent needed and promote a uniform coating of release agent.

Tile base for use in the preferred embodiment of the invention utilizing such material may be manufactured in a conventional manner such as by rolling, milling or extrusion at elevated temperatures, consolidating hot chips of tile base composition, etc. In a typical conventional process a mix of asbestos fiber, other fillers, vinyl chloride copolymer, plasticizer, pigment and light and heat stabilizers are blended to a uniform mastic composition in a high intensity mixer at a temperature generally in the range of from about 280° F to about 320° F and the mix is then consolidated as by milling on a two roll mill to form a pad of mixed material. The thickness of this pad is generally from about ¼ inch to about 2 inches. The pad is then reduced in thickness to approximately 1/16 to ⅛ inch upon passing through conventional sheeters or one or more sets of calender rolls. If desired, opaque and/or translucent plastic chips may be added to the pad on the mill or sheets or between the calender rolls or sheeters to provide desired surface appearance. The resulting vinyl asbestos sheet can be further processed as a plain sheet for production of material of the invention or, if desired, can be embossed or valley printed or otherwise printed with a decorative design with a texture roll.

In producing the product of the present invention material of the type described above is coated on one surface thereof with pressure sensitive adhesive and on the other surface, usually the upper surface thereof, with release agent for such adhesive. Where decorative layers, wear layers, etc. are employed, the release agent, which is preferably transparent, is applied to the surface of the material having such decorative effect and the adhesive is applied to the opposite surface of the material so that upon final application of the material to the wall, floor, or other surface being covered, the adhesive bonds the material to the surface being covered while the release agent provides an additional protective coating over the decorative surface of the material.

Adhesive may be applied to materials such as the above-mentioned tile base in coatings of suitable thickness such as between about 1 and about 5 mils. While continuous coatings of adhesive are possible, it is preferred that adhesive be applied in a discontinuous coating such as a conventional quad, or other conventional printing pattern. Here the adhesive is applied by passing either individual tiles or tile sheet between print roll and pressure roll. The adhesive is deposited in e.g. "quad" design or small pyramids of adhesive. Adhesive is normally used in amounts between about 2 and about 12 grams per square foot (g/ft.$^2$) of surface being coated with adhesive. While it is normally preferred that adhesive be applied in discontinuous coats, it is generally preferred that release agent used in the invention be applied in a continuous coat so as to minimize any chance of adhesive on one piece of finished covering material of the invention contacting decorative surface of another piece of such material unprotected by intervening release agent. Release agent is preferably applied in amounts between about ½ and about 2 g/ft.$^2$ of solids to form coatings having thicknesses between about ¼ and about 1 mil with a minimum thickness of about ¼ mil being preferred to insure protection from adhesive. Release agent may be applied in any suitable manner such as by the use of one or more conventional roll coaters.

Pressure sensitive adhesives suitable for use in the invention include both solvent types in which the adhesive is applied in a solvent solution with the solvent then being driven off by evaporation, emulsion types where the adhesive is applied in a water emulsion with the water being driven off by evaporation and, more preferably, the hot melt type of adhesive where the adhesive is applied above its softening point as a liquid which then cools to a pressure sensitive adhesive. A particularly preferred hot melt type of adhesive is one having as a resin ingredient at least about 10% by weight of a vinylic copolymer, which copolymer contains between about 20 and about 50 wt. % styrene type units and the balance of which copolymer comprises isoprene or butadiene units or mixtures thereof. A particularly preferred hot melt adhesive is one such as described immediately above in which the resin of the adhesive coating is a vinylic block copolymer containing from about 20 to about 35% by weight styrene units, the balance comprising isoprene units. Such adhesives are especially useful where the polymeric block copolymer is present in amounts between about 10 and about 60 wt. % of the adhesive formulation. Suitable block copolymers are available for instance from the Shell Chemical Co. under the trademark Kraton and generally constitute thermoplastic elastomers.

The particularly preferred block copolymers contain a minor portion (i.e. less than 50 percent by weight) of a polystyrene moiety on each end of the polymer chains. Alternatively, poly(alpha-methyl styrene) or other related units may also comprise the chain ends. The central portion of the preferred copolymer chains comprises a polybutadiene or polyisoprene chain, or a mixture of the two units, being present as the major proportion (in excess of 50 percent by weight) of the block copolymer molecule.

It is particularly preferred to select copolymers of the above formulation which, upon congealing when cooled from a melt, form sub-microscopic particles by physical association of the ends of the polymer molecules of a discrete and generally hard phase, while the mid-portions of the copolymer molecule form a continuous, elastomeric phase. Accordingly, these structures, of which Shell's Kraton elastomers are a commercial embodiment, act as a thermoplastic rubber, having good elastic strength properties at lower temperatures, and yet being capable of melting and flowing at high temperatures, and being soluble in various solvents.

The styrene-isoprene block copolymers, which are particularly preferred for use in this application, may have a solution viscosity, as a 10 percent (weight-/volume) solution in cyclohexane at 23° C, of about 90 to 100 centipoises (Brookfield viscosity), and a melt viscosity at 175° C, at a shear rate of 100 sec. $-1$ of about 1,000 to 1,200 poises.

Typical physical properties of the preferred styrene-isoprene block copolymers at 23° C, as determined in a tensile tester having a jaw separation speed of 10 inches per minute, and utilizing A.S.T.M. tpe "D" dumbells, are as follows: Tensile strength-3,000 to 3,200 psi; 300 percent modulus-80 to 120 psi; Elongation-1,200 to 1,400 percent; Angle tear strength-(A.S.T.M. method D 624, die B) 100 to 140 pli; Nicked crescent tear strength-(A.S.T.M. method D 624, die C) 110 to 150 pli.

However, other formulations of the preferred elastomers having different mechanical properties can be utilized, by appropriate changes in the formulation and application processes, for the adhesive used in this invention. For example, high viscosity, hot melt adhesives may be applied by extrusion, rather than by the method disclosed below.

A preferred adhesive formula utilized in this invention may also contain from about 20 to 50 wt. % of an oleoresinous or polyolefinic "tack" promoting agent such as Zonarez polyterpene resin of Arizona Chemical Company, Foral-85 rosin ester of the Hercules Chemical Company, and Betaprene natural polyolefinic hydrocarbon resin of the Reichold Chemical Company, and mixtures thereof.

The preferred adhesive formula may also contain up to fifteen percent of a plasticizer, which functions to further increase tack, elongation and to soften the adhesive. A suitable plasticizer for this purpose is, for instance, Shellflex, sold by the Shell Chemical Company. Other optional ingredients include extender resins such as ethylene-vinyl acetate copolymers, which also function to resist ozone and to act as an anti-oxidant, and other desired anti-oxidants and stabilizing agents against ultraviolet light and the like, which may be added in small quantities. Adhesives useable in this invention may be formulated, for example, in accordance with U.S. Pat. Nos. 3,630,980 and 3,736,281.

Hot melt adhesives other than those mentioned above suitable for use in the invention include, for instance, acrylic based adhesives, amorphous polypropylene, etc. Water-base pressure sensitive emulsion type adhesives may also be used and may be prepared from a product of Rohm and Haas Company identified as N-580 and which may generally be described as a poly(butyl acrylate) latex. Solvent based pressure sensitive adhesives suitable in practicing the invention include, for instance, conventional rubber type adhesives such as those based on styrene and butadiene. Although such adhesives are suitable, their use is generally not preferred because of the problems inherent in pollution control with respect to solvent vapors given off during the drying of the adhesive.

Release agents suitable for use in practicing the invention include conventional release agents such as those based upon silicone polymers and acrylic emulsion polymers. Other release agents such as the water soluble, fatty acid, chrome complexes sold by du Pont under the tradename Quilon are also suitable. A typical structure for Quilon chrome complexes can be represented, for instance, by the following structure:

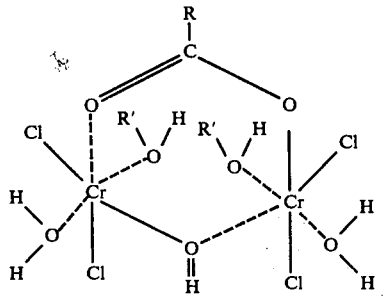

in which R represents the fatty acid radical ($C_{13-17}$) and R' the alkyl group ($C_3$) of the alcohol.

Silicone release agents are typically furnished as two package systems in which one package contains organo polysiloxane and the other package has a metal organic salt catalyst. One such material is marketed, for instance, by Dow Corning Corporation under the tradename SYL-OFF 22, which uses an organo-tin salt as catalyst. Typical of suitable acrylic emulsion polymers for use as release coatings or components or release coatings in the invention is the cross-linkable acrylic emulsion polymer marketed by Rohm and Haas under the tradename Rhoplex R-47.

In a preferred embodiment, release coatings for use in the invention comprise a mixture of acrylic emulsion, silicone release agent (with catalyst) and colloidal silica which serves as an antislip agent. In this preferred embodiment, colloidal silica is usually present in amounts between about 0.25% and about 1.0 wt. %, silicone release agent is frequently present in amounts between about 15 and about 40 wt. % (including catalyst) and acrylic emulsion is frequently present in amounts between about 60 and about 85 wt. %, all based on total release agent composition. In addition, acetic acid is preferably used in small quantities such as between about 0.5 and about 1.0 wt. % to prolong the effective pot life of the catalyzed silicone release agent before the agent is applied to the surface covering to be treated. The weight percentages given herein are based on the material as received which includes water. The weight percent solids for the material described are as follows: silicone emulsion SYL OFF 22, Dow Corning 40%, catalyst 22A Dow Corning 20%; acrylic emulsion Rhoplex TR-407 Rohm and Haas 45.5%; colloidal silica HS-40 duPont 40%; Glacial Acetic Acid 100%. In some cases up to 50% additional water is added to the coating to improve application. All water is driven off after coating by evaporation.

In a further preferred embodiment of the invention, very small amounts such as between about 0.5 and about 2.0 wt. % based on release coating of an ultraviolet luminescent material such as dye or ink are preferably added to the release coating and the coated material is checked by ultraviolet light to determine whether the surface being treated with release coating is completely coated.

The following examples illustrate suitable methods for preparing product of the invention by the process of the invention and are not for the purpose of limiting the invention.

EXAMPLE I

Conventional vinyl asbestos floor tile is prepared in the normal manner except that prior to cutting, an acrylic prime coat such as Rhoplex TR-407 from Rohm and Haas, and a silicone base release coat is applied to the surface of the tile which is above 200° F to accelerate the cure of the coating. The tile are normally cut in either a 9 × 9 inch or 12 × 12 inch size with a thickness of one-sixteenth inch, 0.080 inch, three thirty-seconds inch or one-eighth inch. For this example tiles are cut to 12 × 12 inch size and have a thickness of one-sixteenth inch. The tiles are formed by the conventional mixing, milling and calendering operation from a mix containing the following ingredients:

| Ingredient | Wt. % |
|---|---|
| Vinyl chloride/vinyl acetate copolymer resin | 15 |
| Extender resin (polyα-methyl styrene) | 2 |
| Butylbenzyl phthalate plasticizer | 5 |
| Stabilizer (dicyandiamide) | 1 |
| Asbestos fiber | 20 |
| Limestone | 53 |
| Pigment | 4 |

In this example the release coating applied to the upper surface of the tile material is a mixture of silicone and acrylic emulsion type coatings with colloidal silica added to prevent slippage and acetic acid added to improve pot life of the release coating prior to its coating onto the tile. The release formula used has the following composition:

| Ingredient | Wt. % in Aqueous Solution | % by Wt. Wet |
|---|---|---|
| Aqueous emulsion of organo-polysiloxane (Dow Corning Syl-off 22) | 40 | 30 |
| Organotin salt catalyst | 20 | 6 |
| Acrylic emulsion polymer (Rohm and Haas Rhoplex TR-407) | 45.5 | 63 |
| Colloidal silica (du Pont HS-40) | 40 | 0.25 |
| Glacial acetic acid | 100 | 0.75 |

The above release coating is applied to the tile by a rotary coater at a rate of about 0.5 gram of solids per square foot of tile surface being coated. The release coated tiles are cut into 12 inch by 12 inch squares and are later coated on the back with pressure sensitive adhesive having the following composition:

| Ingredient | Wt. % |
|---|---|
| Styrene-isoprene block copolymer (Kraton 1007-manufactured by the Shell Chemical Company) | 55 |
| Rosin Ester (Foral 85-Hercules) | 33 |
| Tack promoting agent Hydrocarbon resin (such as Beta-prene-Reichhold Chemical Co.) | 10 |
| Dilaurylthiodipropionate-American Cyanamide (anti-oxidant stabilizer) | 1 |
| Triethyl tri-di-tertiarybutylhydrox-benzyl-benzene-Ethyl Corporation (anti-oxidant & ultraviolet stabilizer) | 1 |

The above hot-melt adhesive is applied to the back of the tiles in a quadrangular pattern of 25 quads to the inch in both directions, at a rate of about 4 grams of adhesive per square foot of tile surface.

The term "quad" implies a little pyramid of adhesive, and the above terminology refers to a checkerboard array of small protusions of adhesive, separated by about one-twenty-fifth of an inch for 25 quad.

The adhesive is applied by passing the tile under a printing roll on a M.R. hot-melt coater manufactured by the Specialty Automatic Machine Corp. of Burlington, Mass. The adhesive is applied at a temperature range of 300° to 400° F then cooled by a water-air fogging nozzle.

Following the cooling operation the tiles are packed face down 45 to a box with a sheet of silicone coated release paper placed over the top tile to prevent sticking of the adhesive to the box. The remainder of the tiles in each box have the adhesive coated back of one tile in direct contact with the release coated surface of the adjacent tile. Boxes of tiles prepared as described above may then be stacked for prolonged periods of time in storage or transit and it will be found that even at pressures up to about 200 lbs. per square foot on the bottom tile, the release coat will protect the tile so that separation of tiles from each other may be readily accomplished prior to installation on floors, walls, etc. Such protection is also obtained even when one-eighth inch thick tiles are stacked so that pressure on the bottom tile in a stack of cartons is about 400 lbs. per square foot.

EXAMPLE II

Conventional vinyl asbestos floor tile is prepared in a normal manner except that prior to cutting into individual tiles, adhesive is adhered to the bottom of the sheet of tile material and release coating to the upper surface thereof in accordance with the invention. The tile used has a tile thickness of ⅛ inch and is formed by conventional calendering operations from a mix containing the following ingredients.

| Ingredient | Wt. % |
|---|---|
| Vinyl chloride/vinyl acetate copolymer resin | 15 |
| Extender resin (poly α-methyl styrene) | 2 |
| Butyl benzyl phthalate plasticizer | 5 |
| Stabilizer (dicyandiamide) | 1 |
| Asbestos fiber | 20 |
| Limestone | 53 |
| Pigment | 4 |

In this example the release coating applied to the upper surface of the tile material is a mixture of silicone and acrylic emulsion type coatings with colloidal silica added to prevent slippage and acetic acid added to improve pot life of the release coating prior to its coating onto the tile. The release formula used has the following composition:

| Ingredient | Wt. % in Aqueous Solution | % by Wt. Wet |
|---|---|---|
| Aqueous emulsion of organo-polysiloxane (Dow Corning SYL-OFF 22) | 40 | 30 |
| Organotin salt catalyst | 20 | 6 |
| Acrylic emulsion polymer (Rohm and Haas Rhoplex R-47) | 45.5 | 63 |
| Colloidal Silica (duPont HS-40) | 40 | 0.25 |
| Glacial acetic acid | 100 | 0.75 |

The above release coating is applied to the tile sheet by a rotary coater at a rate of about 0.5 grams of solids per sq. ft. of tile surface being coated. The release-coated tile sheet is then coated on the back with pressure sensitive adhesive having the following composition:

| Ingredient | Wt. % |
|---|---|
| Acrylic emulsion (Rohm and Haas N-580) | 88.0 |
| Polyvinylmethyl ether | 2.0 |
| Alkylphenoxy polyethoxy ethanol wetting agent | 0.3 |
| Methyl ethyl ketone | 0.3 |
| Polyester Plasticizer (Rohm and Haas G-30) | 3.1 |
| Water | 6.3 |

The above adhesive formulation is coated on the back of the tile material using a conventional 17 quad gravure printing roll or roller coater at an application rate of about 3 grams of solids per square foot after evaporating the water, leaving a pressure sensitive adhesive layer about 2 mils thick. Following complete drying of the adhesive the tile material is cut into individual 12 by 12 inch tiles to give 45 sq. ft. to a box and packed face down with a sheet of silicone coated release paper placed over the top tile to prevent sticking of the adhesive to the box. The remainder of the tiles in each box have the adhesive coated back of one tile in direct contact with the release coated surface of the adjacent tile. Boxes of tiles prepared as described above may then be stacked for prolonged periods of time in storage or transit and it will be found that even at pressures up to about 200 lbs. per square foot for 1/16 inch tile on the bottom tile, the release coat will protect the tile so that separation of tiles from each other may be readily accomplished prior to installation on floors, walls, etc.

EXAMPLE III

Vinyl asbestos tiles are prepared as described in Example II, except that the adhesive used is a hot melt adhesive having the composition as shown in Example I.

EXAMPLE IV

Tile is prepared according to Example I except that approximately 1 part luminescent dye visible under ultraviolet light is included in 100 parts of the release agent coating so that the coated material may be checked by ultraviolet light to verify that a continuous coating is in fact applied to the tile.

EXAMPLE V

The release agent of Example I and the adhesive of Example II may be coated on the front and back sides respectively of rigid, decorative panels such as panels of wood or simulated wood suitable for mounting on wall surfaces.

Floor tile prepared according to Example I when stored for periods of time ranging from 3 days to 6 months will be found to have substantially the same bonding strength (when tested according to Resilient Tile Institute Method T-1) with respect to ability to bond to hardboard upon installation as tile prepared in a similar manner except for the use of conventional release paper between stacked pieces of tile rather than the coating of release agent on the decorative surfaces of the tiles in accordance with the invention.

While the invention has been described above with respect to preferred embodiments thereof, it will be understood by those skilled in the art that various changes and modifications may be made without departing from the spirit or scope of the invention.

What is claimed is:

1. A verticle stack of rigid vinyl tiles each of which has pressure sensitive adhesive adhered to one surface thereof and release agent for said adhesive adhered to the opposite surface thereof with individual tiles in such stack being substantially in the horizontal plane and the lowermost tile in each such stack being subjected to a pressure between about 30 and about 500 lbs. per square foot.

2. A stack of tiles according to claim 1 in which the release agent is a silicone release agent.

3. A stack of tiles according to claim 1 in which:

a. The adhesive comprises at least about 25 wt % of a vinylic block copolymer containing between about 20 and about 40 wt % styrene units with the balance of the block copolymer comprising isoprene units;

b. the release agent comprises a silicone release agent and;

c. the tile comprises between about 10 and about 30 wt % vinyl chloride homopolymers, vinyl chloride/vinyl acetate copolymers or mixtures thereof, between about 10 and about 30 wt % asbestos fibers, between about 50 and about 80 wt % limestone and between about 4 and about 15 wt % plasticizer.

4. A stack of tiles according to claim 1 in which the adhesive is of the hot melt type and comprises as a resin ingredient at least about 10% by weight of a vinylic copolymer containing between about 20 and about 50 wt. % styrene type units, the remainder of said copolymer being selected from the group consisting of isoprene, butadiene and mixtures thereof.

5. A stack of tiles according to claim 4 in which said resin ingredient of the adhesive is a vinylic block copolymer containing between about 20 and about 40 wt. % styrene units with the balance comprising isoprene units.

6. A stack of tiles according to claim 5 in which:

a. the adhesive adhered to the vinyl tiles is a discontinuous coat between about 2 and about 5 mils thick and is present in amounts between about 2 and about 10 grams per square foot of tile surface to which adhesive is adhered; and b. the release agent is adhered to the vinyl tiles in a continuous coat having a minimum thickness of about 0.25 mil.

7. A stack of tiles according to claim 6 in which the vinyl tiles comprise vinyl chloride/vinyl acetate copolymer having a ratio of vinyl chloride units to vinyl acetate units between about 4 to 1 and about 10 to 1 and further include between about 4 and about 15 wt. % plasticizer for the vinyl chloride/vinyl acetate copolymer.

8. A stack of tiles according to claim 7 in which the release agent is a silicone release agent, acrylic release agent or mixture thereof and the vinyl tiles include between about 50 and about 80 wt. % filler.

9. A process for making and packaging rigid vinyl tile comprising:

a. forming a plurality of pieces of rigid vinyl tile, each of said pieces having pressure sensitive adhesive adhered to one surface thereof and a release agent for said adhesive adhered to the opposite surface thereof; and b. stacking said pieces for storage in such a manner that at least a majority of the surfaces of said pieces having adhesive adhered thereto are in direct contact with surfaces of said pieces having release agent adhered thereto.

10. The process of claim 9 in which the pieces of covering material are individual vinyl floor or wall tiles.

11. The process of claim 10 in which the tiles are stacked vertically with individual tiles in such stack being substantially in the horizontal plane and the lowermost tile in such stack being subjected to a pressure between about 30 and about 500 lb./ft.$^2$.

12. A process according to claim 11 in which:

a. the adhesive comprises at least about 25 wt % of a vinylic block copolymer containing between about 20 and about 40 wt % styrene units with the balance of the block copolymer comprising isoprene units;

b. the release agent comprises a silicone release agent and;

c. the tile comprises between about 10 and about 30 wt % vinyl chloride homopolymers, vinyl chloride/vinyl acetate copolymers or mixtures thereof, between about 10 and about 30 wt % asbestos fibers, between about 50 and about 80 wt % limestone and between about 4 and about 15 wt % plasticizer.

13. A stack of vinyl tiles produced by the process of claim 11.

* * * * *